US005503194A

United States Patent [19]

Steiner et al.

[11] Patent Number: 5,503,194

[45] Date of Patent: Apr. 2, 1996

[54] WARP GUIDING DEVICE MODULE FOR A SERIES-SHED WEAVING MACHINE

[75] Inventors: Alois Steiner, Rieden; Andreas Hunziker, Wald; Peter Grimm, Rüti, all of Switzerland

[73] Assignee: Sulzer Rueti AG, Rueti, Switzerland

[21] Appl. No.: 289,168

[22] Filed: Aug. 11, 1994

[30] Foreign Application Priority Data

Sep. 24, 1993 [EP] European Pat. Off. ..... 93810681

[51] Int. Cl.[6] ..... D03D 49/02; D03D 41/00

[52] U.S. Cl. ..... 139/28; 139/35; 139/97

[58] Field of Search ..... 28/189, 203.1, 28/204, 205, 213; 139/28, 35, 97

[56] References Cited

U.S. PATENT DOCUMENTS 4,290,458 9/1981 Steiner ..... 139/28

4,498,501 2/1985 Steiner ..... 139/28

FOREIGN PATENT DOCUMENTS 903190 3/1986 Belgium .

0013321 7/1980 European Pat. Off. .

0557752 9/1993 European Pat. Off. .

9208800 U 12/1992 Germany .

*Primary Examiner*—Andy Falik

*Attorney, Agent, or Firm*—Townsend and Townsend and Crew

[57] ABSTRACT

A warp guiding device which includes a holding device for mounting a number of warp guide bars (23) and driving devices (24) for moving the warp guide bars is integrally constructed so that it can be brought into and out of operational connection with a weaving rotor of a series-shed weaving machine. The weaving machine includes an installation arrangement for receiving and securing the warp guiding device on the weaving machine.

10 Claims, 3 Drawing Sheets

1
6
7
27
29
33
35
36
37
38
39
40
41
43
44
45

WARP GUIDING DEVICE MODULE FOR A SERIES-SHED WEAVING MACHINE

BACKGROUND OF THE INVENTION

The invention concerns a warp guiding device and also a series-shed weaving machine having a warp guiding device.

SUMMARY OF THE INVENTION

It is an object of the present invention to provide a warp guiding device for a series-shed weaving machine in the form of a constructional unit which is installable in and removable from the weaving machine with little effort.

An essential advantage of the invention is that changing the cloth or article to be woven by the weaving machine can be carried out easily, and by machine in a short time.

It is advantageous when the drive comprises a coupling device in order to couple the driving device with the weaving rotor, and an adjusting device for aligning the warp guide bars with respect to the weaving rotor. The coupling device advantageously comprises a gear coupling. The weaving rotor and the warp guiding device can be easily and exactly aligned in the radial direction by means of the coupling device, and in particular the gear coupling, and can be easily and exactly aligned in the axial direction by means of the adjusting device.

DESCRIPTION OF THE PREFERRED EMBODIMENTS

Figure 1:
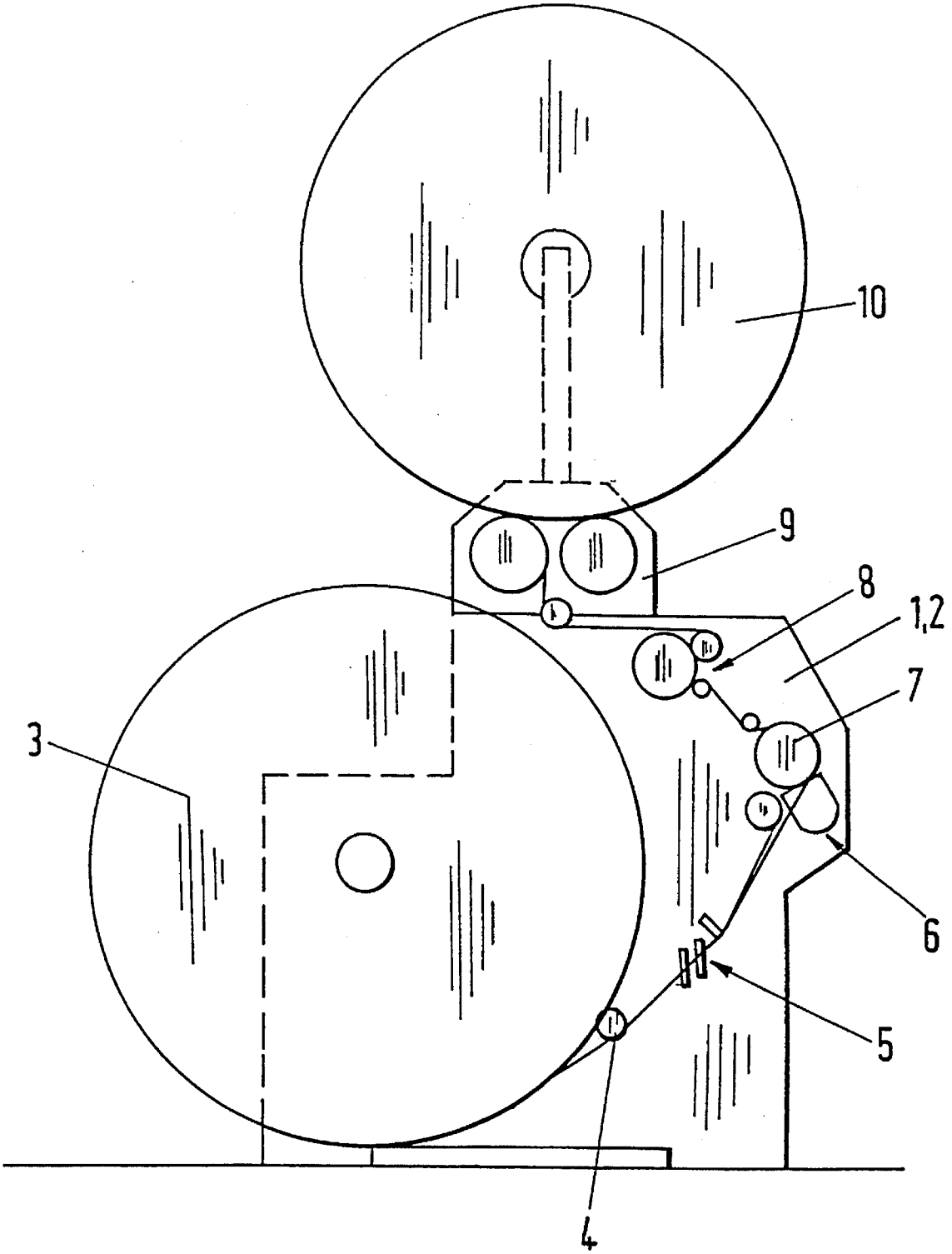
FIG. 1 shows a series-shed weaving machine constructed according to the invention.

FIG. 1 shows a series-shed weaving machine which has a frame having two frame walls 1, 2, a warp beam 3, a whip roll 4, a warp stop motion device 5, a warp guiding device 6, a weaving rotor 7, a cloth take-off device 8, a winding device 9 and a cloth beam 10. The warp guiding device is parallel to and extends substantially over the length of the weaving rotor. With the warp guiding device 6 under discussion here the weaving shed is produced by the warp guide bars.

Figure 2:
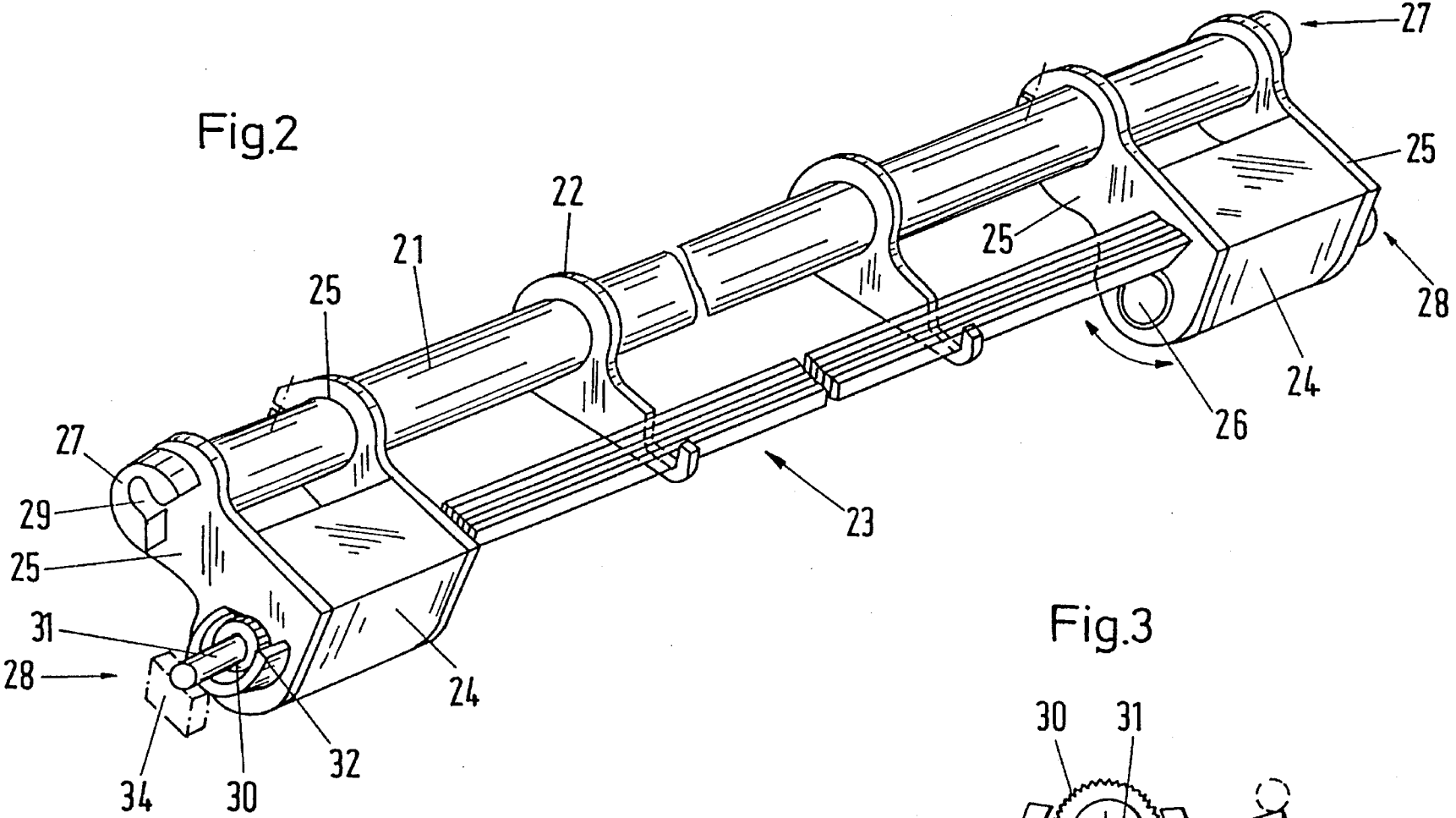
FIG. 2 is a perspective view which illustrates a warp guiding device constructed according to the invention.

As shown in FIG. 2, the warp guiding device 6 is realized as a constructional unit or module and, in this embodiment, is easily insertable into and removable from the series-shed weaving machine. This operation can be carried out automatically. The warp guiding device 6 contains a carrier 21 having a number of firmly connected holders 22 spaced from each other and having the same alignment, a number of warp guide bars 23 and two driving devices 24 in order to move the warp guide bars to and fro in their longitudinal direction. The driving device 24 is fixed by the holder 25 to the carrier 21.

The driving device 24 comprises a cam mechanism (not shown) which converts a rotational movement into a translational movement for the warp guide bars 23, and an adjusting device 26 connected with the cam mechanism and rotatably held in the drive housing in order to position the warp guide bars through rotation of the cam mechanism. A scale (not shown) is provided to facilitate the adjustment.

The warp guiding device 6 is provided at both of its ends with a respective receiving part 27 and a coupling device 28. The receiving part 27 has a recess 29. The coupling device 28 contains a gear wheel 30 which is mounted on the drive shaft 31 of the driving device 24, and a supporting shell 32 which partly surrounds the toothed wheel 30. The coupling device 28 comprises further a rim gear 33 which is fixed on the weaving rotor 7 (FIG. 5).

Figure 3:
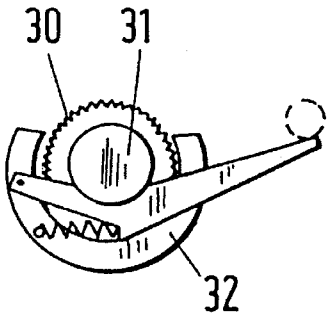
FIG. 3 is a view of a device illustrated in FIG. 2 for preventing unwanted rotation.

The warp guiding device contains a device 34 which prevents a rotation of the coupling device 28 and consequently a displacement of the warp guide bars 23. For this purpose, the device 34 is formed as a brake device subjected to the bias force of a spring and acting on the drive shaft 31 (FIG. 3).

Figures 4, 5, 6:
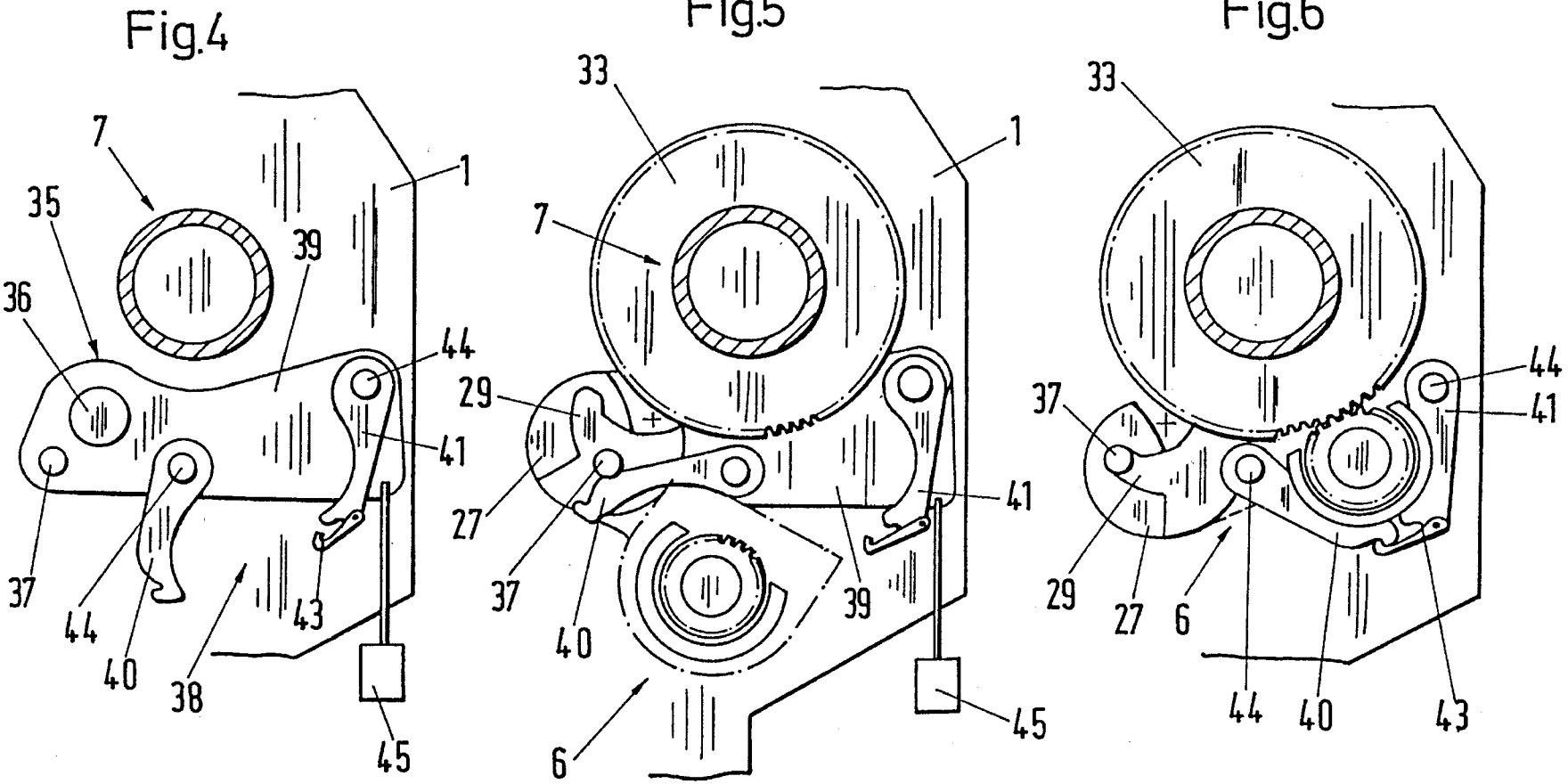
FIG. 4 shows an arrangement of a receiving device for a warp guiding device in a series-shed weaving machine.
FIG. 5 is a view which shows the warp guiding device before it is installed on the series-shed weaving machine.
FIG. 6 shows the warp guiding device in its installed condition.

For the installation of the above-described device, a receiving device is provided which comprises at least two installation arrangements 35, one of these being shown in FIG. 4. One installation arrangement is respectively provided on each of the opposite, confronting sides of the frame walls 1, 2. The installation arrangement of FIG. 4 is swingably arranged on a pivot 36 fixed in the frame wall. The installation arrangement 35 comprises a support 37 and a fixing device 38, which are secured to a supporting plate 39. The fixing device includes a lever arrangement which comprises first and second levers 40, 41 and a quick fastener 43. The first and second levers are journalled on pivots 44 which are fixed in the suppporting plate 38. The quick fastener 43 is arranged on one of the levers 41. The supporting plate 39 is connected to a positioning device 45, such as a working cylinder, an electric motor or an energy accumulator, etc., in order to swing the installation arrangement 35 about the pivot 36.

The installation of the warp guiding device 6 can be seen from FIGS. 5 and 6. In the illustration of FIG. 5, the installation arrangement 35 is held in the operating position by the positioning device and the warp guiding device 6 is held in a receiving position by a holding device (not shown). Thereafter, the installation arrangement 35 is swung out of the operating position into a receiving position, that is, away from the weaving rotor 7, with the help of the positioning device. In this way, the support 37 is introduced into the recess 29 in the receiving part 27. Finally, the levers 40, 41 are placed around the support shell 32 and connected to each other by the quick fastener 43. Thus, the warp guiding device 6 is arranged in the installation arrangement 35. The installation arrangement is now positioned again in the operating position by means of the positioning device, the gear wheel 30 of the coupling device 28 comes into engagement with the rim gear 33 of the weaving rotor 7, and the warp guiding device is simultaneously aligned radially with the weaving rotor 7. The warp guide bars 23 are then aligned axially relative to the weaving rotor 7 by means of the adjusting device 26.

What is claimed is:

1. Warp guiding device for a series-shed weaving machine having a weaving rotor, the device comprising holding means having a carrier mountable parallel to the weaving rotor, a number of warp guide bars arranged on the holding means, said carrier including means for displaceably supporting said warp guide bars in their lengthwise direction and at least one driving device for moving the warp guide bars in their lengthwise direction, the holding means, the warp guide bars and the driving device forming an integral unit for movement into and out of operational connection with the weaving rotor.

2. A device according to claim 1, wherein the driving device comprises a coupling device for coupling the driving device with the weaving rotor, and an adjusting device for aligning the warp guide bars with respect to the weaving rotor.

3. A device according to claim 1 including two driving devices, each driving device comprising a coupling device.

4. A device according to claim 2, wherein the coupling device comprises a gear coupling.

5. A series-shed weaving machine comprising first and second, spaced-apart frame walls, a weaving rotor journalled in the frame walls, a warp guiding device including holding means having a carrier mountable parallel to the weaving rotor, a plurality of longitudinally displaceable warp guide bars arranged on the holding means and at least one driving device for longitudinally moving the warp guide bars, the holding means, the warp guide bars and the driving device forming an integral unit, an installation arrangement associated with each frame wall for the warp guiding device, and a positioning means connected to one of the installation arrangement and the warp guiding device for bringing the weaving rotor into and out of operational connection with the warp guiding device.

6. Weaving machine according to claim 5, wherein the positioning means comprises a driving device selected from the group consisting of a working cylinder, an electric motor and an energy accumulator.

7. Weaving machine according to claim 5, wherein the weaving rotor comprises at least one coupling member for coupling the driving device of the warp guiding device with the weaving rotor.

8. Weaving machine according to claim 7, wherein the weaving rotor has two coupling members.

9. Weaving machine according to claim 7, wherein the coupling member comprises a rim gear fixed to the weaving rotor.

10. Weaving machine according to claim 5 wherein the installation arrangement comprises a support and a fixing device including a quick fastener for the fixing of the warp guiding device.

* * * * *